US009401543B2

(12) United States Patent
You et al.

(10) Patent No.: US 9,401,543 B2
(45) Date of Patent: Jul. 26, 2016

(54) BROADBAND ANTENNA

(71) Applicant: Wistron NeWeb Corporation, Hsinchu (TW)

(72) Inventors: Shang-Sian You, Hsinchu (TW); Chien-Ting Huang, Hsinchu (TW)

(73) Assignee: Wistron NeWeb Corporation, Hsinchu Science Park, Hsinchu (TW)

( * ) Notice: Subject to any disclaimer, the term of this patent is extended or adjusted under 35 U.S.C. 154(b) by 111 days.

(21) Appl. No.: 14/463,669

(22) Filed: Aug. 20, 2014

(65) Prior Publication Data

US 2015/0200456 A1 Jul. 16, 2015

(30) Foreign Application Priority Data

Jan. 14, 2014 (TW) ..... 103200771 U

(51) Int. Cl.

| | |
|---|---|
| ***H01Q 1/00*** | (2006.01) |
| ***H01Q 5/321*** | (2015.01) |
| ***H01Q 9/42*** | (2006.01) |
| ***H01Q 5/371*** | (2015.01) |
| ***H01Q 5/378*** | (2015.01) |

(52) U.S. Cl.

CPC ..... *H01Q 5/321* (2015.01); *H01Q 5/371* (2015.01); *H01Q 5/378* (2015.01); *H01Q 9/42* (2013.01)

(58) Field of Classification Search

CPC ..... H01Q 1/243; H01Q 1/38; H01Q 9/0421; H01Q 5/371

USPC ..... 343/722, 876, 702

See application file for complete search history.

(56) References Cited

U.S. PATENT DOCUMENTS

| | | | | |
|---|---|---|---|---|
| 4,335,469 | A * | 6/1982 | Tharp | H03H 7/38 343/703 |
| 2007/0229376 | A1* | 10/2007 | Desclos | H01Q 1/243 343/718 |
| 2008/0180333 | A1* | 7/2008 | Martiskainen | H01Q 1/243 343/722 |
| 2009/0146905 | A1* | 6/2009 | Morita | H01Q 1/38 343/895 |
| 2010/0060531 | A1* | 3/2010 | Rappaport | H01Q 1/243 343/702 |

* cited by examiner

*Primary Examiner* — Dameon E Levi
*Assistant Examiner* — Collin Dawkins
(74) *Attorney, Agent, or Firm* — Winston Hsu; Scott Margo

(57) ABSTRACT

A broadband antenna for a wireless communication device includes a grounding unit for grounding; a first radiating element; a second radiating element electrically connected to the grounding unit; a signal feed-in element for transmitting a radio signal to the first radiating element in order to emit the radio signal via the first radiating element; and a passive component comprising an inductor, where the passive component is electrically connected between the first and the second radiating elements to work in conjunction with the first radiating element, the second radiating element and the grounding unit to form a loop antenna effect.

8 Claims, 11 Drawing Sheets

BROADBAND ANTENNA

BACKGROUND OF THE INVENTION

1. Field of the Invention

The present invention relates to a broadband antenna, and more particularly, to a broadband antenna which comprises an inductor for increasing the antenna bandwidth, adjusting the impedance matching, and reducing the antenna dimensions.

2. Description of the Prior Art

Electronic products with wireless communication functionalities, such as laptops, tablet PCs, personal digital assistants (PDAs), mobile phones, wireless base stations, smart meters, and USB dongles, utilize antennas to send and receive wireless signals so as to access wireless networks. With the rise of the Long Term Evolution (LTE) technology, there has been a significant increase in demand for broadband antennas, as broadband antennas may improve the transmission rate of wireless communication products. On the other hand, it is also required that the antenna size should be as small as possible in order to meet demand for smaller and lighter products.

The common broadband planar antennas used for LTE systems are planar inverted-F antennas and coupled type antennas. A planar inverted-F antenna has conductive pins which can assist with impedance matching; however, this kind of antenna generally occupies larger space for achieving broadband and high radiation efficiency. A coupled type antenna is generally smaller in size, but its performance can be vulnerable to environment fluctuations and it is hard to design for good impedance matching.

In addition, antennas need to conform to the regulations for Specific Absorption Rate (SAR). Therefore, the antennas used by mobile devices such as tablet PCs, laptops, and mobile phones are usually non-stereo type. However, it is quite challenging to design a non-stereo type antenna with good radiation efficiency. Since reducing external interference to the wireless communication device (i.e. reducing the SAR value) usually comes with the side effect of an impact on radiation efficiency, it is not easy to design an antenna with good radiation efficiency while the antenna also passes the qualification on its SAR.

Therefore, how to increase the bandwidth and efficiency of the antenna that conforms to the SAR regulation while minimizing the antenna size is an important topic that needs to be addressed and discussed.

SUMMARY OF THE INVENTION

An objective of the present invention is to provide a broadband antenna, which incorporates a coupled type antenna with an inductor to increase the antenna bandwidth, adjust the impedance matching, and reduce the antenna dimensions.

An embodiment of the present invention discloses a broadband antenna for a wireless communication device. The broadband antenna includes a grounding unit, for providing ground; a first radiating element; a second radiating element, electrically connected to the grounding unit; a signal feed-in element, for transmitting a radio signal to the first radiating element in order to emit the radio signal via the first radiating element; and a passive component, comprising an inductor, wherein the passive component is electrically connected between the first and the second radiating elements or between a metal part of the first radiating element and the second radiating element to work in conjunction with the first radiating element, the second radiating element, and the grounding unit to form a loop antenna effect.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
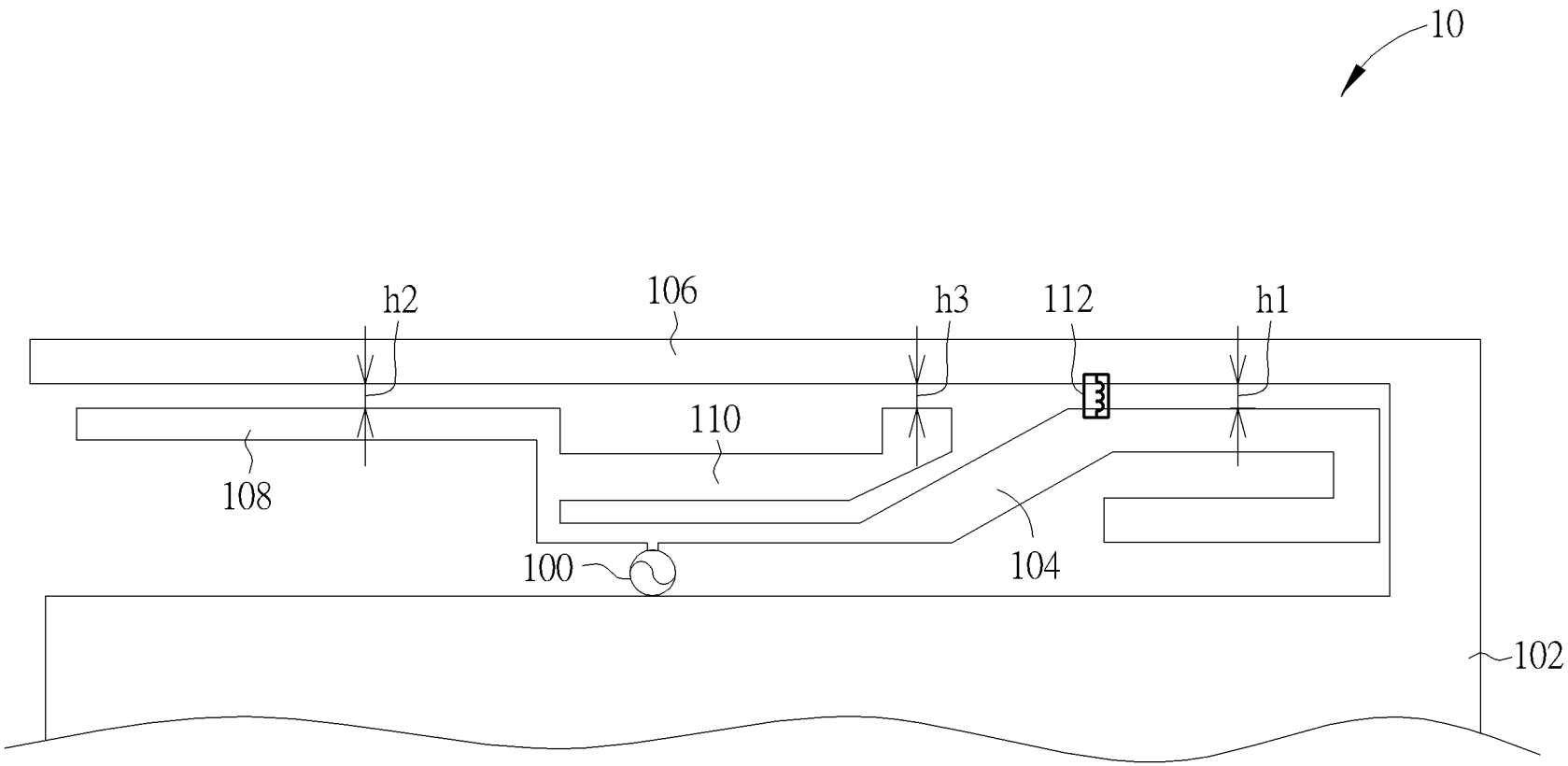
FIG. 1 is a schematic diagram of a broadband antenna according to an embodiment of the present invention.

FIG. 1 shows a schematic diagram of a broadband antenna 10 according to an embodiment of the present invention. The broadband antenna 10 may be used in a wireless communication device for transmitting or receiving radio signals of a wide frequency band or multiple frequency bands, such as signals of a Long Term Evolution (LTE) wireless communication system, where its operational frequency bands are located approximately at 704 MHz-960 MHz and 1710 MHz-2700 MHz. The broadband antenna 10 includes a signal feed-in element 100, a grounding unit 102, a first radiating element 104, a second radiating element 106, and an inductor 112. The first radiating element 104 may be connected to a metal part. The metal part may include a third radiating element 108 and a fourth radiating element 110. The grounding unit 102 is used for providing ground. A ground terminal of the signal feed-in element 100 may be connected to a system grounding unit of the wireless communication device or the ground line of a coaxial cable. The other terminal of the signal feed-in element 100 is used for transmitting a radio signal to the first radiating element 104 such that the radio signal is emitted via the first radiating element 104, the third radiating element 108, and the fourth radiating element 110. In addition, the radio signal is fed into the second radiating element 106 which is electrically connected to the grounding unit 102 by coupling. The inductor 112 is electrically connected between the first radiating element 104 and the second radiating element 106. Alternatively, the inductor 112 may be electrically connected between a metal part of the first radiating element 104 and the second radiating element 106. As such, the inductor 112 works in conjunction with the first radiating element 104, the second radiating element 106, and the grounding unit 102 to form a loop antenna effect.

The broadband antenna 10 may be regarded as a combination of a monopole antenna and a parasitic element. The first radiating element 104, the third radiating element 108, and the fourth radiating element 110 are high frequency radiating elements, representing the monopole antenna, while the second radiating element 106 is a low frequency radiating element, representing the parasitic element. The high frequency radiating elements and the low frequency radiating element are coupled with each other; therefore, the antenna disposition space may be efficiently used. Furthermore, the coupling effect lowers a resonant frequency and also creates multiple resonant modes in high frequency bands. Consequently, an antenna with broad operational frequency bands may be achieved. The inductor 112 may be connected in series between the radiating elements 104, 108, 110, and the second radiating element 106 for providing a resonant path in the low operational frequency modes, which may be used to adjust the matching, the bandwidth, and the shifting of the resonant frequencies to achieve a miniaturized broadband antenna with ultra wide band and high efficiency characteristics.

In detail, each of the lengths of the first radiating element 104, the second radiating element 106, the third radiating element 108, and the fourth radiating element 110 is designed to be substantially equal to a quarter-wavelength of a resonant frequency. The second radiating element 106 provides a resonant path for a low operational frequency mode, which primarily creates the 704 MHz-960 MHz frequency band. The second radiating element 106 may also create some high frequency resonant modes, thereby increasing the bandwidth of the broadband antenna 10.

Figure 2A:
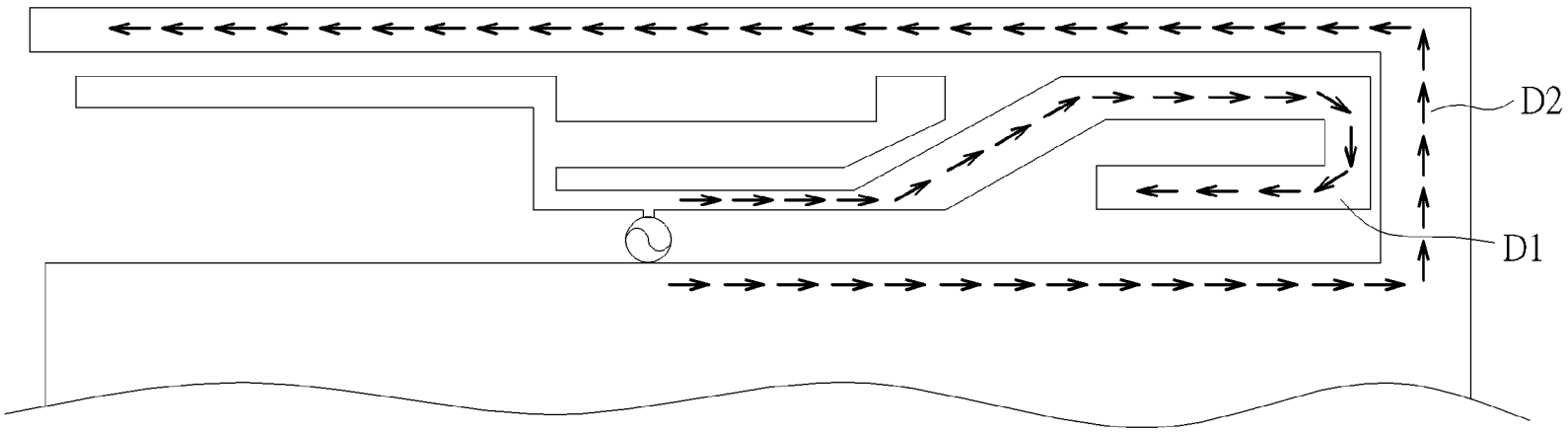
FIG. 2A depicts the current direction of the broadband antenna shown in FIG. 1 without including the inductor.

The broadband antenna 10 can also operate normally without the inductor 112. In such a situation, the resonant current on the first radiating element 104 and the second radiating element 106 are depicted in FIG. 2A. Noticeably, the induced current direction D1 of the radio signal on the first radiating element 104 is opposite to the induced current direction D2 of the radio signal on the second radiating element 106. Since the induced current on the first radiating element 104 and the second radiating element 106 are opposite, an operational frequency mode may be induced in the 900 MHz-1100 MHz frequency band. Designing the induced current on the first radiating element 104 and the second radiating element 106 to be opposite is one of the factors for increasing the bandwidth of the low frequency band.

The coupling gaps h1, h2, and h3 exist between the second radiating element 106 and the radiating elements 104, 108, 110, respectively. The matching of the two low operational frequency modes may be adjusted by tuning the size and the length of the coupling gaps h1, h2, and h3 in order to achieve an optimum impedance matching. Since the first radiating element 104, the third radiating element 108, and the fourth radiating element 110 are coupled with the second radiating element 106, the second radiating element 106 and the third radiating element 108 may be shortened significantly, which therefore reduces the antenna dimensions.

On the other hand, the first radiating element 104, the third radiating element 108, and the fourth radiating element 110 provide resonant paths for high operational frequency modes, which primarily create the 1710 MHz-2700 MHz frequency band. More specifically, the third radiating element 108 creates the lower frequency resonant modes (1710 MHz-2170 MHz) of the high operational frequency band, and the first radiating element 104 and the fourth radiating element 110 create the medium and higher parts (2170 MHz-2700 MHz) of the high operational frequency band. Some harmonics may be induced by appropriately adjusting the coupling gap h1 between the first radiating element 104 and the second radiating element 106. As a result, the bandwidth of the lower frequency part of the high operational frequency band may be broadened, and the required radiating energy of the 1710 MHz-2700 MHz frequency band and the other frequency bands may be altered.

Figure 2B:
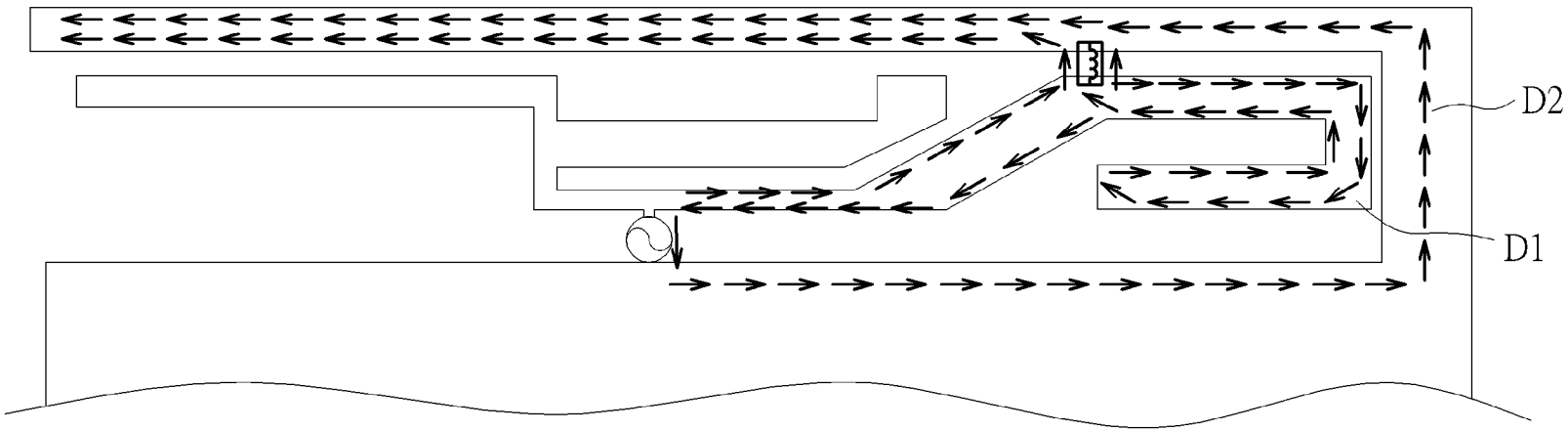
FIG. 2B depicts the current direction of the broadband antenna shown in FIG. 1.
Figure 3A:
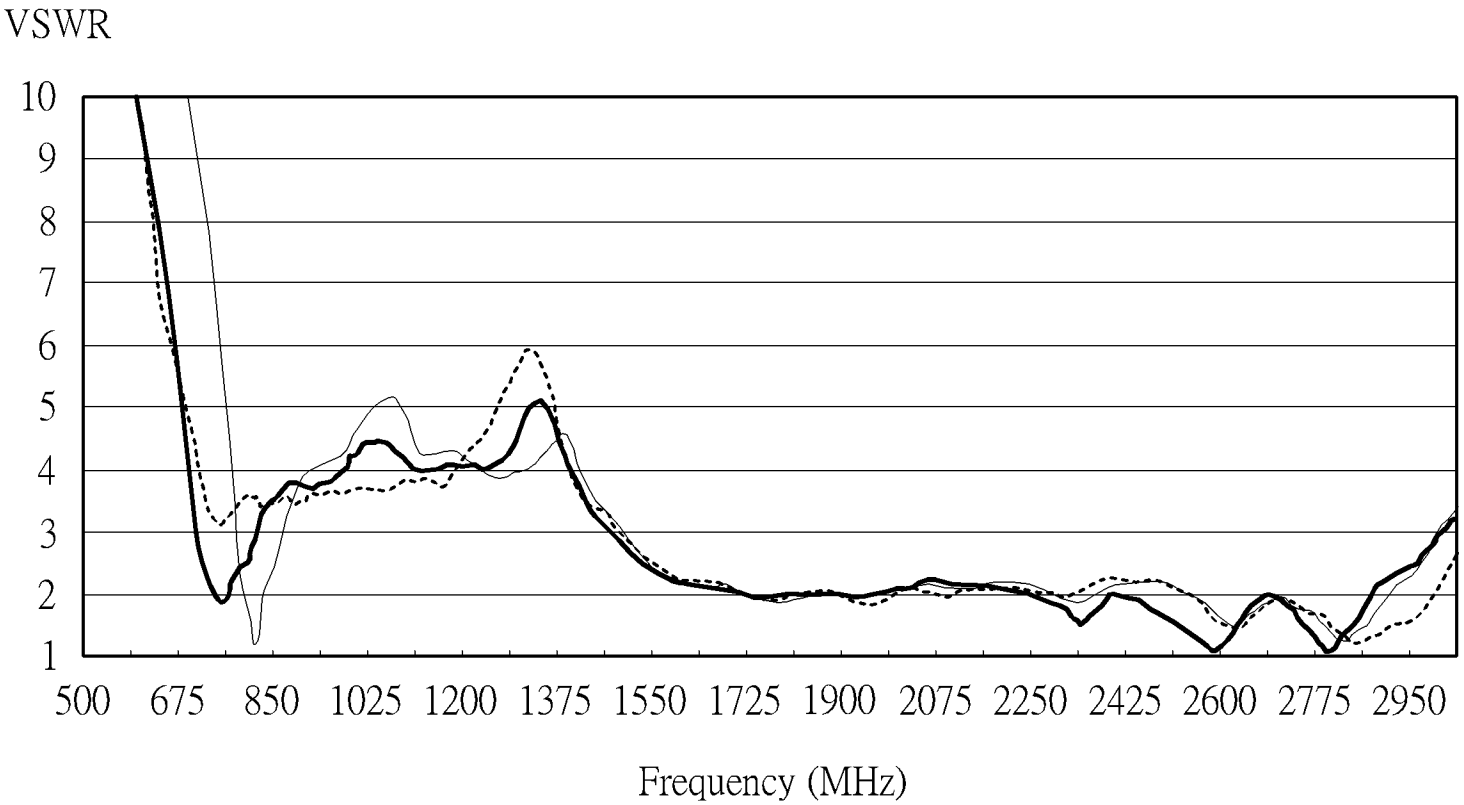
FIG. 3A is a voltage standing wave ratio (VSWR) diagram of the broadband antenna shown in FIG. 1.
Figure 3B:
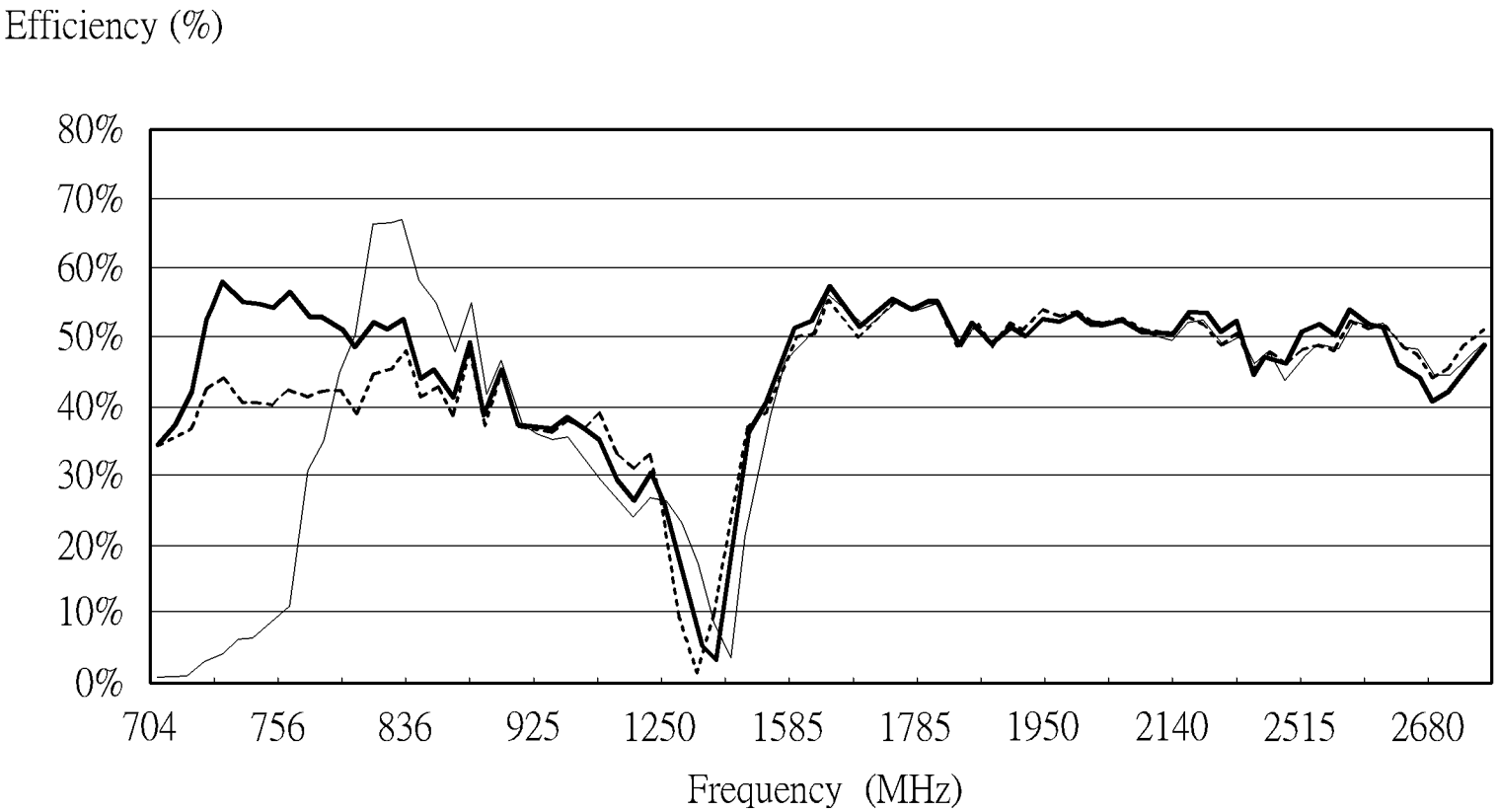
FIG. 3B is a radiation efficiency diagram of the broadband antenna shown in FIG. 1.

In addition, the broadband antenna 10 includes the inductor 112 which is connected between the low frequency radiating element and the high frequency radiating elements for forming a loop antenna effect with the first radiating element 104, the second radiating element 106, and the grounding unit 102. Within a range of specific inductance values, the current path of the low frequency band becomes longer (compared to FIG. 2A) as shown in FIG. 2B when the broadband antenna 10 includes the inductor 112. The high frequency current is suppressed by the inductor 112. Moreover, the inductor does not influence the high frequency harmonics, so it may be used to adjust the matching of the low operational frequency band. For a smaller inductance value, the inductor 112 may allow more high frequency current to pass through it so that the loop antenna effect of low frequency band is reduced. Under this condition, the low operational frequency band is narrower, the matching is better, and the radiating energy is more converged. On the contrary, for a larger inductance value, the inductor 112 may allow less high frequency current to pass through it so that the loop antenna effect of low frequency band is increased. Under this condition, the low operational frequency band is broader, the matching is worse, and the radiating energy is more dispersed. The impact of the inductor 112 on antenna characteristics is evidenced by the antenna measurement results shown in FIG. 3A and FIG. 3B. FIG. 3A is a voltage standing wave ratio (VSWR) diagram of the broadband antenna 10, and FIG. 3B is a radiation efficiency diagram of the broadband antenna 10. In FIG. 3A and FIG. 3B, the dotted line denotes the antenna characteristics of the broadband antenna 10 without the inductor 112, the thin line denotes the antenna characteristics of the broadband antenna 10 where the inductance value of the inductor 112 is about 22 nH, and the thick line denotes the antenna characteristics of the broadband antenna 10 where the inductance value of the inductor 112 is about 56 nH. As shown in FIG. 3B, the antenna has broader bandwidth and better radiation efficiency when the inductor 112 has appropriate inductance value (e.g. the thick line). When the inductor 112 has smaller inductance value, without adjusting the antenna structure the broadband antenna 10 may have better efficiency in the low frequency band that complies with the LTE specification.

The embodiment of the present invention disposes a passive component such as an inductor between a monopole antenna and a parasitic element for increasing the antenna bandwidth, adjusting the impedance matching, and reducing the antenna dimensions. FIG. 1 is an example of the present invention, and those skilled in the art may make modifications and/or alterations accordingly. In the example of FIG. 1, the metal part connecting to the first radiating element 104 includes the third radiating element 108 and the fourth radiating element 110, but is not limited herein. The metal part connecting to the first radiating element 104 may also include more radiating elements or only include one radiating element or a simple metal connecting element, as long as the electrically connecting characteristics of the metal part enables the inductor 112 to work in conjunction with the first radiating element 104, the second radiating element 106, and the grounding unit 102 to form a loop antenna effect. The inductor 112 is not limited to be disposed on the same position as that shown in FIG. 1.

Figure 4:
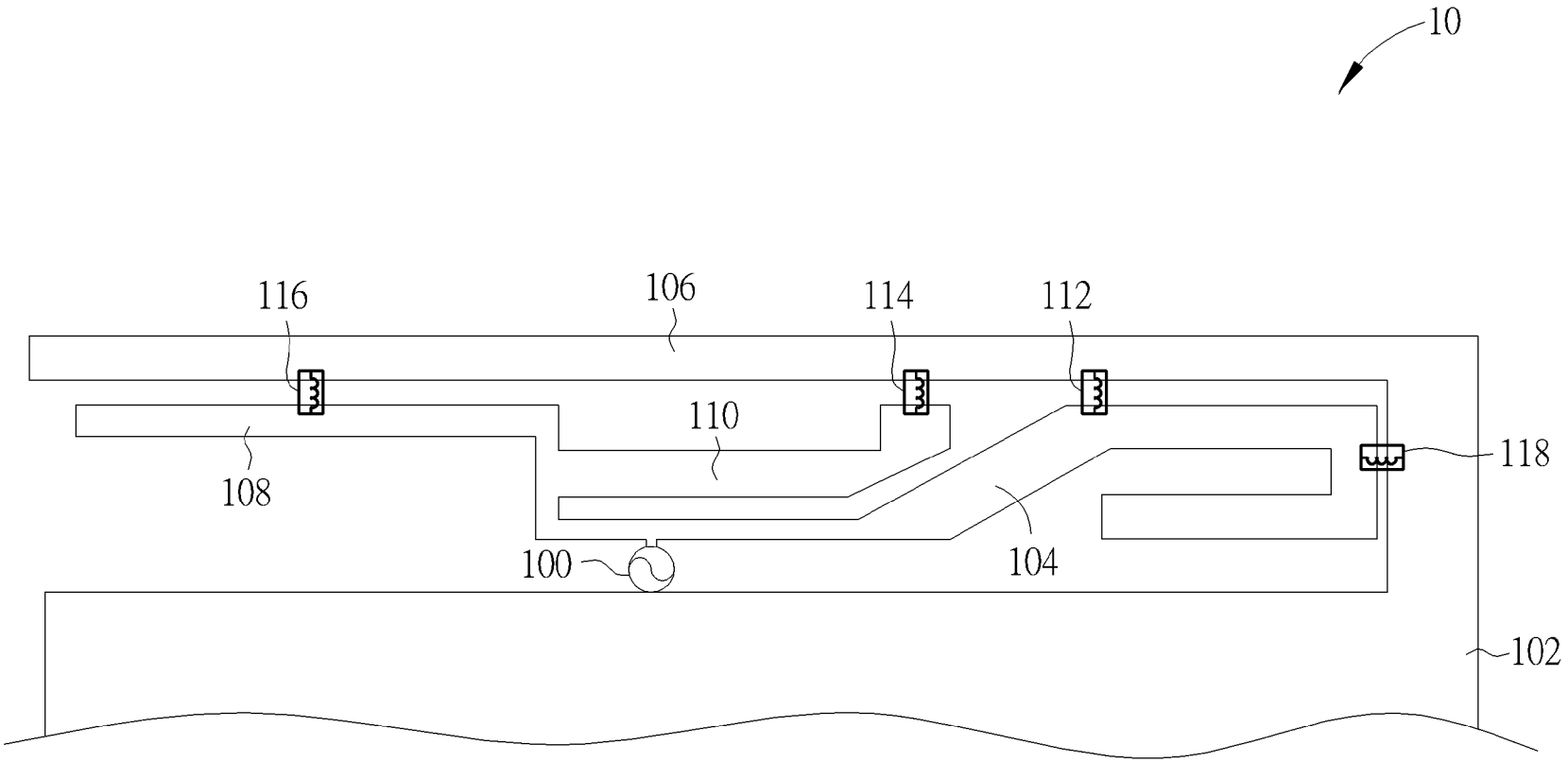
FIG. 4 is a schematic diagram of a broadband antenna according to another embodiment of the present invention.
Figure 5A:
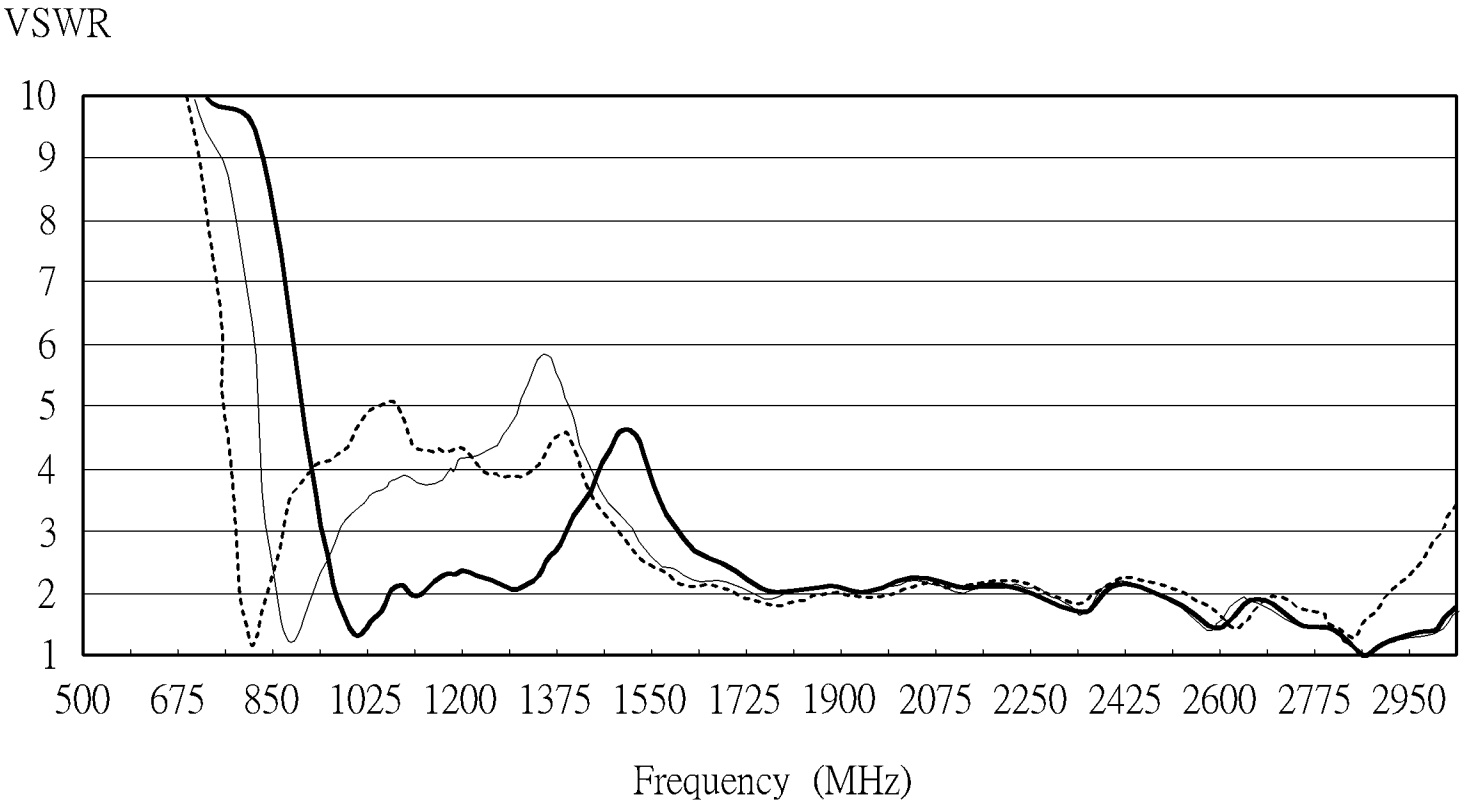
FIG. 5A is a voltage standing wave ratio (VSWR) diagram of the broadband antenna shown in FIG. 4.
Figure 5B:
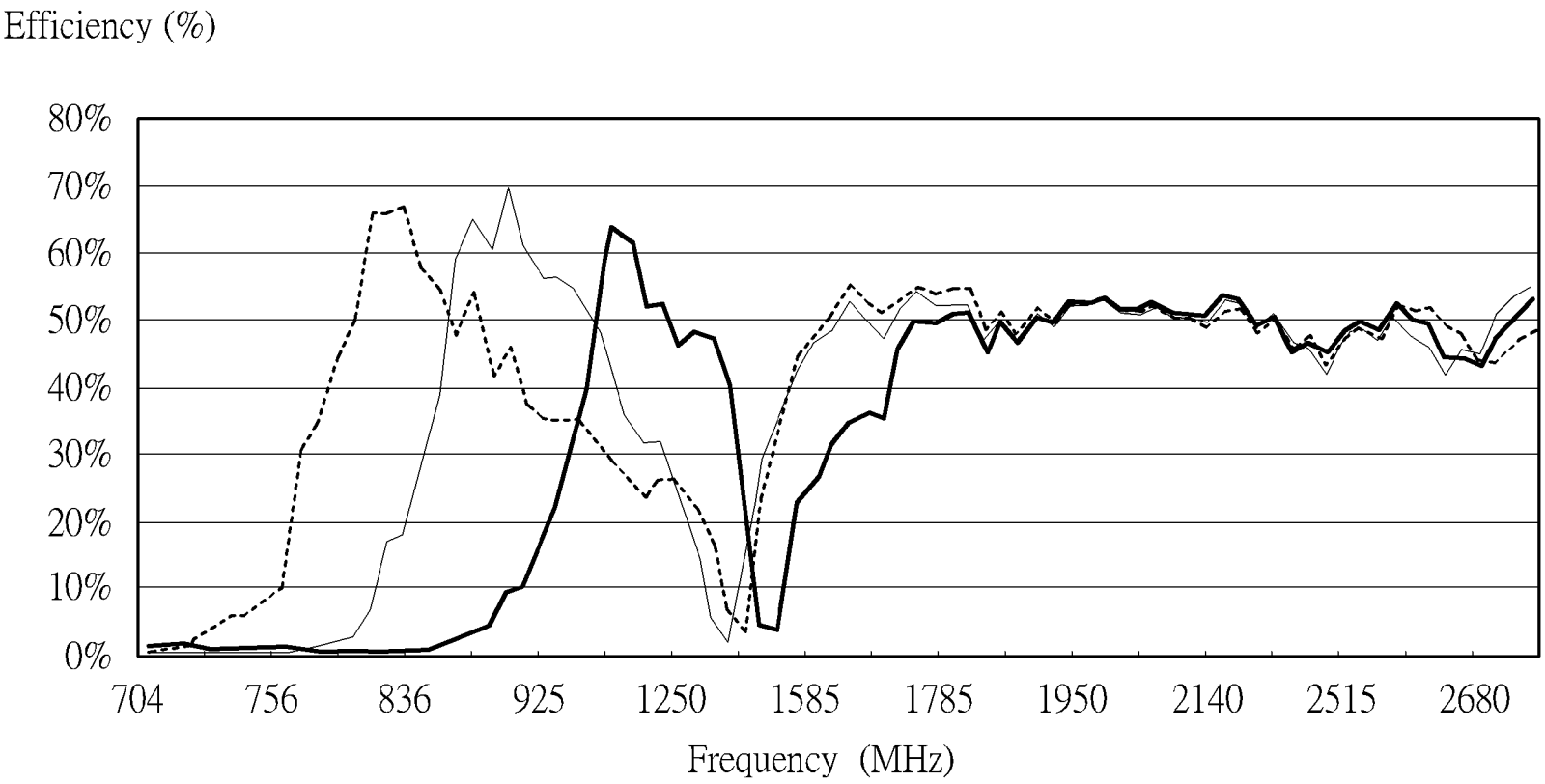
FIG. 5B is a radiation efficiency diagram of the broadband antenna shown in FIG. 4.

The inductor 112 may be disposed on any other position as long as the inductor 112 is electrically connected between the first radiating element 104 and the second radiating element 106 or between the metal part connecting to the first radiating element 104 (e.g., the third radiating element 108 or the fourth radiating element 110) and the second radiating element 106. As shown in FIG. 4, the inductor may be, for example, the inductor 112, the inductor 114, the inductor 116, or the inductor 118. Changing the position of the inductor may alter the current path on the low frequency radiating element of the broadband antenna 10, and therefore result indifferent low frequency resonant modes. FIG. 5A is a voltage standing wave ratio (VSWR) diagram of the broadband antenna 10, and FIG. 5B is a radiation efficiency diagram of the broadband antenna 10, where the inductor is disposed on different positions. In FIG. 5A and FIG. 5B, the thick line denotes the antenna characteristics of the broadband antenna 10 where the inductor is disposed on the position as the inductor 112 shown in FIG. 4, the thin line denotes the antenna characteristics of the broadband antenna 10 where the inductor is disposed on the position as the inductor 114 shown in FIG. 4, and the dotted line denotes the antenna characteristics of the broadband antenna 10 where the inductor is disposed on the position as the inductor 116 shown in FIG. 4. As evidenced by FIG. 5A and FIG. 5B, the position of the inductor determines the operational frequency of the antenna. Thus, the inductance value and the position of the inductor may be appropriately selected so that the operational frequency of the broadband antenna 10 can induce all the required resonant modes of the low frequency band (704 MHz-960 MHz) of an LTE system.

Moreover, the broadband antenna of an embodiment of the present invention may also include capacitor as one of the passive component. For example, the inductor 112 may be replaced by one or more inductors and/or capacitors connected in series, or one or more inductors and/or capacitors and the inductor 112 may be connected in parallel in order to form a filter-like circuit. As a result, the radiating elements may conduct current under certain operational frequency so that the loop antenna effect may be formed in specific frequency bands. Accordingly, the frequency response of the antenna may be adjusted.

Figure 6:
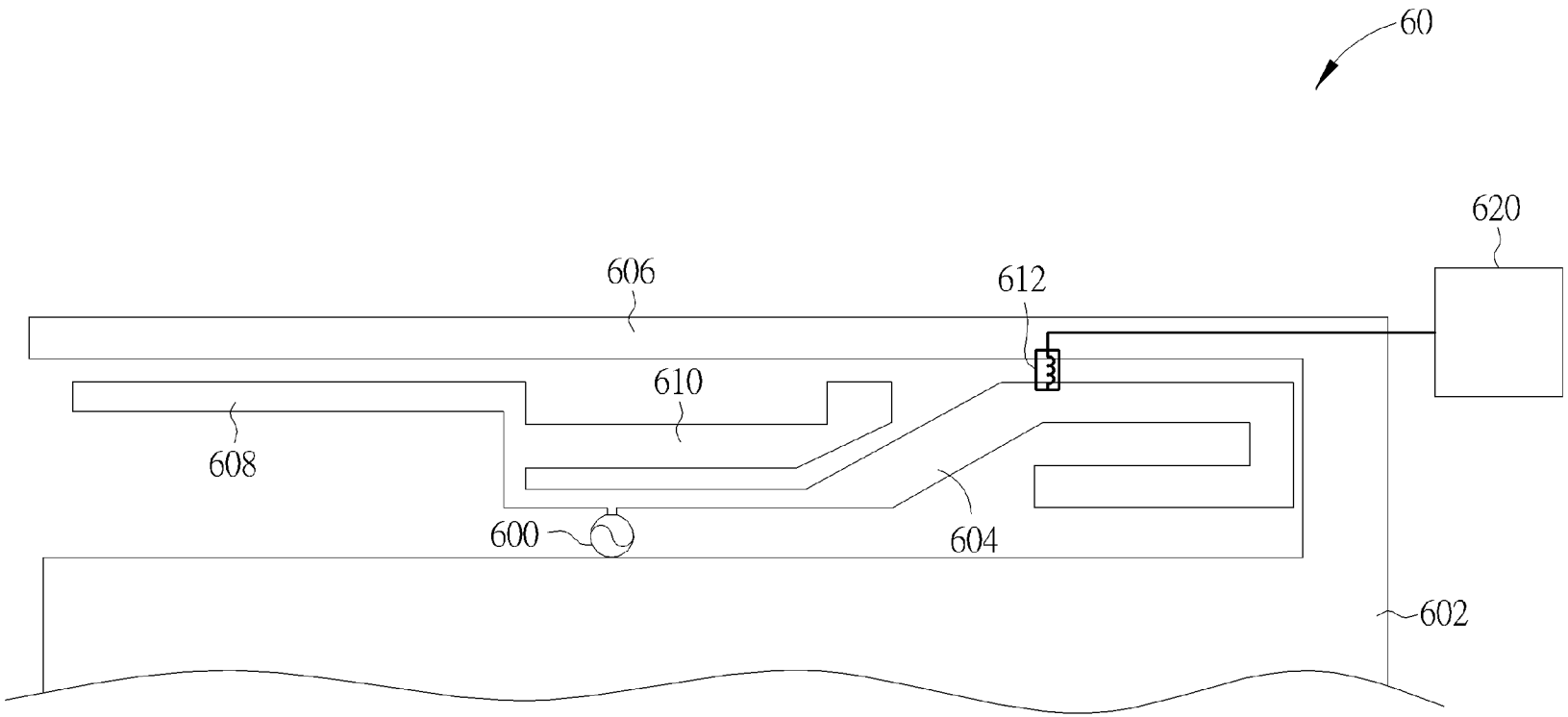
FIG. 6 is a schematic diagram of a broadband antenna according to another embodiment of the present invention.

Alternatively, tunable inductors or tunable capacitors may be utilized in the broadband antenna. The inductance or capacitance value may be controlled by the communication system to adjust the available operational frequencies in the low frequency band so as to comply with the antenna performance requirement of different specifications. Referring to the example shown in FIG. 6, the inductor 612 included in the broadband antenna 60 is a tunable inductor. The inductor 612 may be coupled to a sensor hub 620 in the wireless communication device. The sensor hub 620 may be used to switch an inductance value of the inductor 612, which therefore adjusts the resonant frequency and the matching of the broadband antenna 60 to comply with the antenna performance requirement of different specifications.

Figure 7:
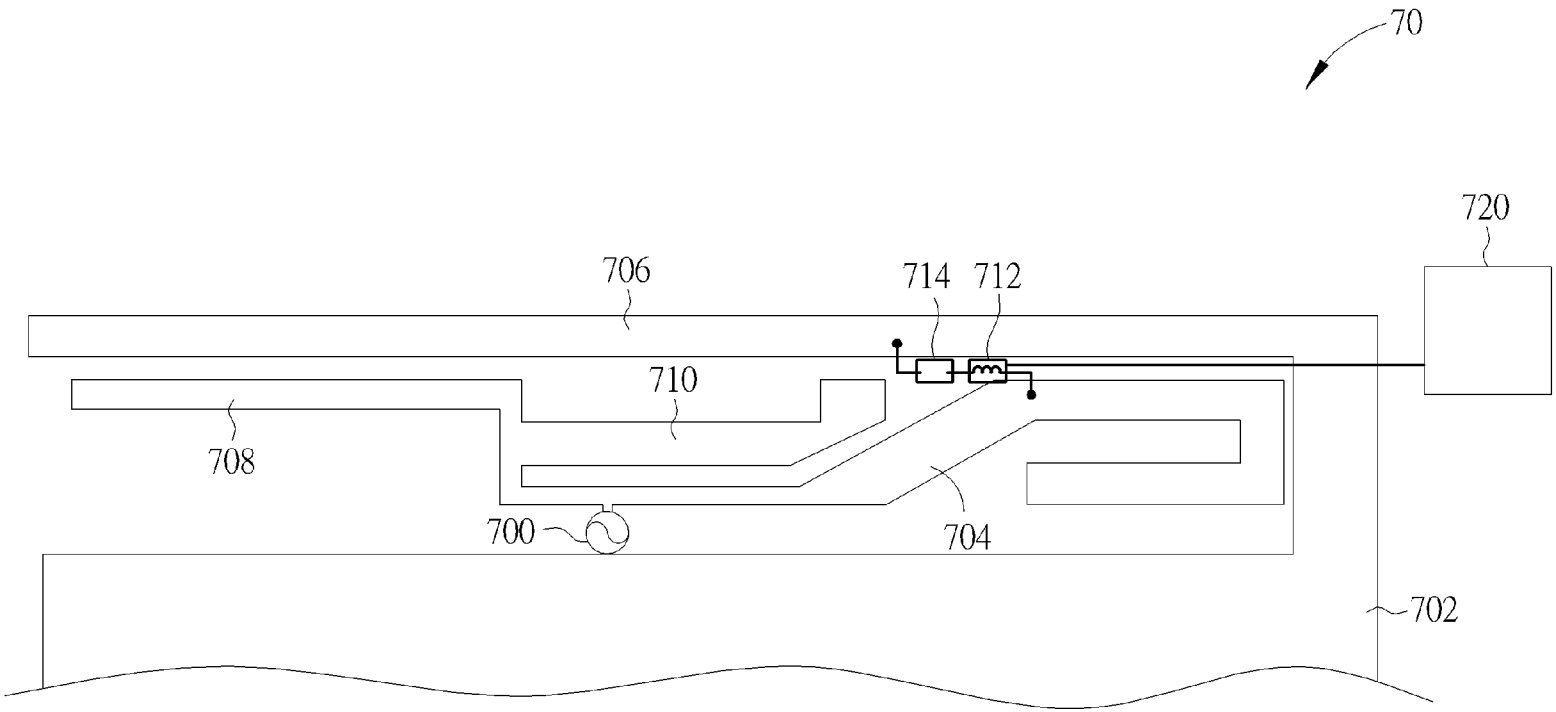
FIG. 7 is a schematic diagram of a broadband antenna according to another embodiment of the present invention.

Referring to the example shown in FIG. 7, the broadband antenna 70 includes a tunable inductor 712 and a passive component 714 which are connected in series. The passive component 714 may be a tunable capacitor. The tunable inductor 712 and the passive component 714 connected in series may work as a band-pass filter such that only signals of specific frequency band are transmitted. With the passive components, the broadband antenna 70 also forms a loop antenna effect, and thus the matching of the antenna may be adjusted.

Figure 8:
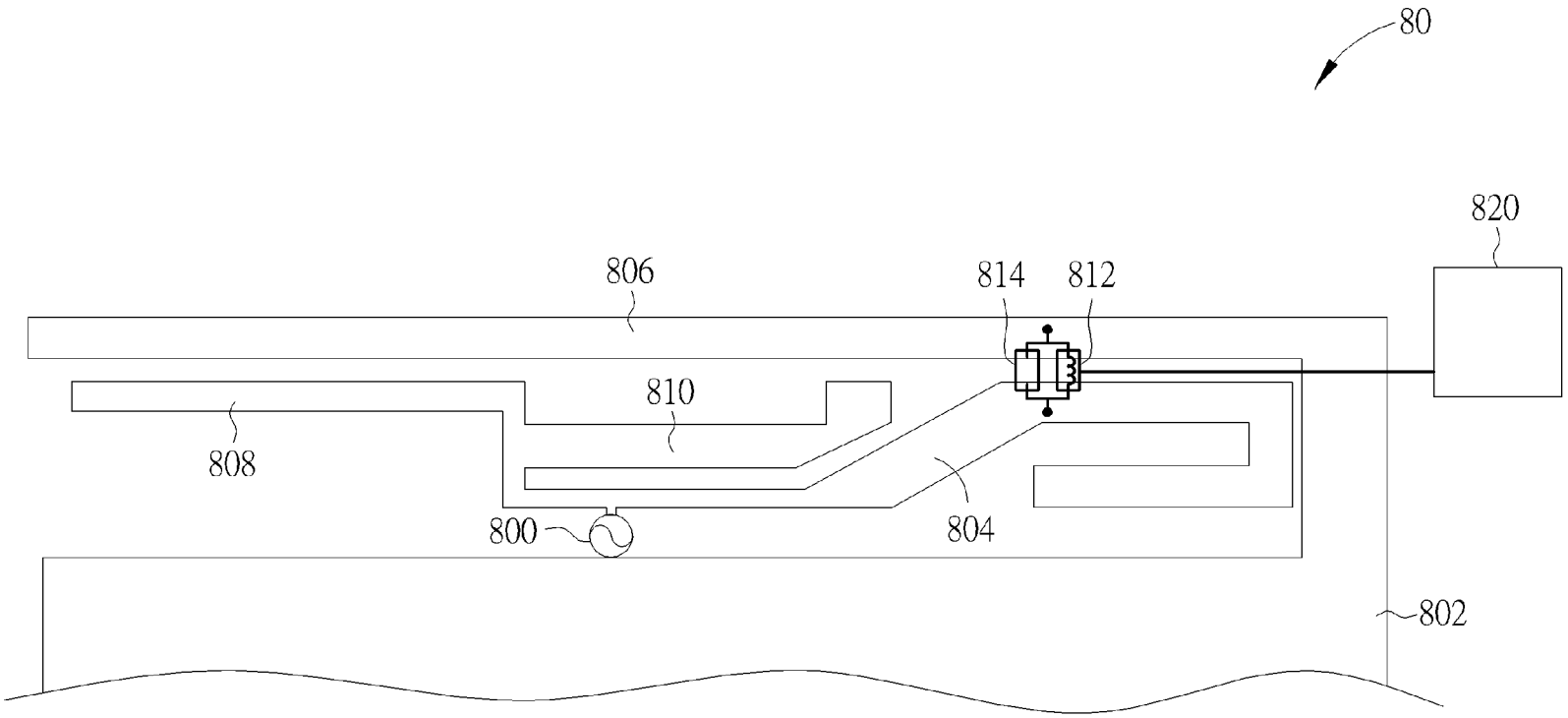
FIG. 8 is a schematic diagram of a broadband antenna according to another embodiment of the present invention.

Referring to the example shown in FIG. 8, the broadband antenna 80 includes a tunable inductor 812 and a passive component 814 which are connected in parallel. The passive component 814 may be a tunable capacitor. The tunable inductor 812 and the passive component 814 connected in parallel may work as a band-stop filter such that only signals of specific frequency band are transmitted. With the passive components, the broadband antenna 80 also forms a loop antenna effect, and thus the matching of the antenna may be adjusted.

The aforementioned steps and means to adjust the matching of the antenna may be selectively combined together in order to comply with the requirements of different communication applications.

Furthermore, the antenna radiation frequency, bandwidth and efficiency are closely correlated with the antenna shape and the materials used in the antenna. Therefore, designers may appropriately modify the broadband antennas 10, 60, 70 and 80 to comply with requirements of the wireless communication systems. Note that the examples and embodiments mentioned above are used to illustrate the concept of the present invention, which utilizes passive elements such as capacitors and inductors disposed between the high frequency radiating element and the low frequency radiating element that coupled with each other for improving the antenna bandwidth and impedance matching. Any alterations and modifications such as varying the material, manufacturing methods, shape, and position of the components should be within the scope of the present invention as long as the concept of the present invention is met.

In conclusion, the embodiment of the present invention utilizes the high frequency radiating element and the low frequency radiating element that coupled with each other to lower the low frequency resonant modes and induce multiple modes in the high frequency band so as to achieve the broadband characteristic. In addition, the embodiment of the present invention utilizes a passive component including an inductor and electrically connects the passive component between the high frequency radiating element and the low frequency radiating element in order to provide a path for low frequency resonant modes. The passive component may be used to adjust the impedance matching, the bandwidth, and the frequency shift of the antenna. Therefore, a broadband, high efficiency, miniaturized antenna may be designed according to the examples provided in the present invention.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A broadband antenna for a wireless communication device, comprising:

a grounding unit, for providing ground;

a first radiating element;

a second radiating element, electrically connected to the grounding unit;

a signal feed-in element, for transmitting a radio signal to the first radiating element in order to emit the radio signal via the first radiating element; and a passive component, comprising an inductor, wherein the passive component is electrically connected between a metal part of the first radiating element and the second radiating element to work in conjunction with the first radiating element, the second radiating element, and the grounding unit to form a loop antenna effect;

wherein the metal part comprises a third radiating element, electrically connected to the first radiating element, wherein a second coupling gap exists between the third radiating element and the second radiating element such that the radio signal is fed into the third radiating element from the second radiating element by coupling;

wherein the metal part further comprises a fourth radiating element, electrically connected to the third radiating element, wherein the fourth radiating element extends toward the same direction as the first radiating element.

2. The broadband antenna of claim 1, wherein a first coupling gap exists between the first radiating element and the second radiating element such that the radio signal is fed into the second radiating element from the first radiating element by coupling.

3. The broadband antenna of claim 1, wherein the induced current direction of the radio signal on the first radiating element is opposite to the induced current direction of the radio signal on the second radiating element.

4. The broadband antenna of claim 1, wherein the induced current direction of the radio signal on the third radiating element is the same as the induced current direction of the radio signal on the second radiating element.

5. The broadband antenna of claim 1, wherein the passive component further comprises one or more additional inductors or capacitors, in series or in parallel to the inductor.

6. The broadband antenna of claim 5, wherein the one or more capacitors are tunable capacitors.

7. The broadband antenna of claim 1, wherein the inductor is a tunable inductor.

8. The broadband antenna of claim 1, wherein the inductor is coupled to a sensor hub of the wireless communication device for switching an inductance value of the inductor so as to adjust a harmonic frequency and the matching of the radio signal.

* * * * *